US006634959B2

(12) United States Patent
Kuesters

(10) Patent No.: US 6,634,959 B2
(45) **Date of Patent: *Oct. 21, 2003**

(54) GOLF BALL LOCATOR

(75) Inventor: Eckhard H. Kuesters, Woodbine, MD (US)

(73) Assignee: Oblon, Spivak, McClelland, Maier & Neustadt, P.C., Alexandria, VA (US)

( * ) Notice: Subject to any disclaimer, the term of this patent is extended or adjusted under 35 U.S.C. 154(b) by 203 days.

This patent is subject to a terminal disclaimer.

(21) Appl. No.: 09/754,279

(22) Filed: Jan. 5, 2001

(65) Prior Publication Data

US 2002/0091017 A1 Jul. 11, 2002

(51) Int. Cl.[7] ..... A63B 43/06

(52) U.S. Cl. ..... 473/353; 473/131; 473/152; 473/155; 473/156; 473/199

(58) Field of Search ..... 473/131, 353, 473/152, 155, 198, 199, 200, 165, 156, 570; 700/91, 92, 93

(56) References Cited

U.S. PATENT DOCUMENTS

| | | | | | |
|---|---|---|---|---|---|
| 3,351,347 | A | | 11/1967 | Smith et al. | 273/213 |
| 3,458,205 | A | | 7/1969 | Smith et al. | 273/213 |
| 3,782,730 | A | | 1/1974 | Horchler | 273/213 |
| 3,886,553 | A | | 5/1975 | Bates et al. | 343/112 R |
| 4,229,740 | A | | 10/1980 | Krilanovich | 343/113 R |
| 4,742,357 | A | | 5/1988 | Rackley | 342/457 |
| 4,783,071 | A | * | 11/1988 | Tattershall | 283/34 |
| 4,791,572 | A | | 12/1988 | Green, III et al. | 364/449 |
| 4,799,062 | A | | 1/1989 | Sanderford, Jr. et al. | 342/450 |
| 4,926,161 | A | * | 5/1990 | Cupp | 340/988 |
| 5,003,317 | A | | 3/1991 | Gray et al. | 342/457 |
| 5,029,866 | A | | 7/1991 | Beard, III et al. | 273/181 R |
| 5,095,430 | A | | 3/1992 | Bonito et al. | 364/410 R |
| 5,097,416 | A | | 3/1992 | Matthews | 364/410 |
| 5,112,055 | A | | 5/1992 | Barnhill | 273/213 |
| 5,324,028 | A | | 6/1994 | Luna | 273/32 R |
| 5,342,051 | A | | 8/1994 | Rankin et al. | 273/185 A |
| 5,413,345 | A | | 5/1995 | Nauck | 273/185 R |
| 5,423,549 | A | | 6/1995 | Englmeier | 273/213 |
| 5,438,518 | A | * | 8/1995 | Bianco et al. | 340/995 |
| 5,447,314 | A | | 9/1995 | Yamazaki et al. | 273/213 |
| 5,469,175 | A | * | 11/1995 | Boman | 342/357.03 |
| 5,489,099 | A | * | 2/1996 | Rankin et al. | 434/252 |
| 5,564,698 | A | | 10/1996 | Honey et al. | 273/128 R |
| 5,582,550 | A | | 12/1996 | Foley | 473/153 |
| 5,641,963 | A | | 6/1997 | Mueller | 250/342 |
| 5,664,880 | A | * | 9/1997 | Johnson et al. | 473/407 |
| 5,689,431 | A | * | 11/1997 | Rudow et al. | 340/990 |
| 5,717,406 | A | | 2/1998 | Sanderford et al. | 342/457 |
| 5,740,077 | A | * | 4/1998 | Reeves | 463/3 |
| 5,743,815 | A | * | 4/1998 | Helderman | 473/152 |
| 5,751,409 | A | | 5/1998 | Koyama | 356/3.14 |
| 5,772,534 | A | * | 6/1998 | Dudley | 473/131 |
| 5,797,809 | A | | 8/1998 | Hyuga | 473/407 |
| 5,873,797 | A | * | 2/1999 | Garn | 473/407 |
| 5,910,057 | A | | 6/1999 | Quimby et al. | 473/353 |
| 5,938,545 | A | | 8/1999 | Cooper et al. | 473/407 |
| 6,113,504 | A | | 9/2000 | Kuesters | 473/353 |
| 6,241,622 | B1 | * | 6/2001 | Gobush et al. | 473/199 |
| 6,263,279 | B1 | * | 7/2001 | Bianco et al. | 342/357.08 |
| 6,278,457 | B1 | * | 8/2001 | Bernardini et al. | 345/420 |
| 6,320,173 | B1 | * | 11/2001 | Vock et al. | 250/206.1 |

FOREIGN PATENT DOCUMENTS

| | | |
|---|---|---|
| FR | 2616335 | 12/1988 |
| GB | 2247177 | 2/1992 |

* cited by examiner

*Primary Examiner*—Michael O'Neill
*Assistant Examiner*—Christina Marks
(74) *Attorney, Agent, or Firm*—Oblon, Spivak, McClelland, Maier & Neustadt, P.C.

(57) ABSTRACT

A golf ball locator system including a golf ball including an electromagnetic signal transmitter; at least two electromagnetic signal receivers configured to receive an electromagnetic signal transmitted by the golf ball; and a processor coupled to the receivers and configured to receive signals from the receivers, to determine a location of the golf ball using triangulation calculations, and to output at least one signal indicating the location of the golf ball in relation to a two-dimensional area including the location of the golf ball.

86 Claims, 8 Drawing Sheets

GOLF BALL LOCATOR

CROSS-REFERENCE TO RELATED APPLICATIONS

This application relates to U.S. Pat. No. 6,113,504 issued Sep. 5, 2000, the entire contents of which are incorporated by reference herein.

BACKGROUND OF THE INVENTION

1. Field of the Invention

The present invention relates to a golf ball locator system and a golf ball used in the system.

2. Discussion of the Background

All golf players, especially beginners, are familiar with the frustration of losing a golf ball. Beyond the embarrassment of losing golf balls, golf players suffer a loss of time in trying to locate them, the loss of money in purchasing new golf balls, and a loss of concentration, not to mention the penalty imposed for losing golf balls during competition.

A number of schemes have been proposed to address this issue. For example, GB1172449 teaches radioactive material inside a golf ball and a handheld Geiger counter to locate it. GB1172449 states that "the quantity and nature of the radioactive material should be chosen so that the resulting intensity of radiation will not be injurious to a human being handling the golf ball . . .". This system has, therefore, a rather severe constraint that limits its detection range. Furthermore, unrecovered radioactive golf balls could accumulate within a golf course and could, over time, render the golf course less than safe.

Another document related to golf ball location is FR 2616335. This document teaches a golf ball with an electromagnetic wave transmitter consisting of an integrated circuit comprising a timing circuit. In this device, the golf player holds a locating device featuring a visual and/or sound signal which has an intensity in relation to the distance from the golf player to the golf ball. As in the first example, this device's detection range is limited to a local area. In fact, FR 2616335 teaches that the power of the transmitter is determined so that a ball can only be detected within a given parameter, for example, 100 meters.

In Englmeier (U.S. Pat. No. 5,423,549), a golf ball transmits electromagnetic signals to a mobile signal receiving unit for locating golf balls. Further provided is a voltage source that is recharged through a wireless transmission, and a timing circuit. The mobile signal receiving unit produces an output signal that has an intensity in relation to the distance from the golf player to the golf ball.

A problem with devices such as these is the extensive search that a golf player has to perform in order to locate his or her golf ball. In fact, a golfer having just teed off, must first place himself or herself within the detection range of the device. This initial step has to be performed without the help of a locating device, and in cases where the golfer's line of vision is obstructed by obstacles, this initial step may not be successful, so that the golf ball is never recovered. Once the golfer is within range of the golf ball, the second step is to rotate up to 360° to determine the general direction from which the golf ball's signal is coming. Finally, the golfer must walk forward slowly in that direction until he or she finds the golf ball. This procedure may lead to enough frustration and loss of time that the golfer may choose to abandon the search, and may therefore defeat the very purpose of the golf ball locator.

A second problem with the above mentioned examples of related art is the fact that these devices only provide information about the position of a golf ball relative to a signal receiving device. In other words, they do not provide any information on the location of the golf balls relative to other landmarks on the golf course, such as the flag, the sand bunkers, the club house or other buildings and significant obstacles.

SUMMARY OF THE INVENTION

Consequently, there is a need for a system to locate golf balls safely, providing individual golfers with the location of their lost golf balls within a range that can span an entire golf course, or any portions thereof. Furthermore, there is a need for a system to provide golfers with the position of their golf balls relative to various obstacles and targets of a golf course. Such information would be useful to the golfers, especially beginners, who are unsure of the distances between their golf ball and various obstacles or targets and are therefore unsure of the type of club needed for the next shot.

Accordingly, one object of this invention is to safely provide a system capable of giving individual golfers the location of their golf ball.

Another object of the present invention is to provide a system locating golf balls within a range that can span an entire golf course or portions thereof, for example a single hole.

Still another object of the present invention is to provide a system in which all the functions performed to give the location of the golf ball are performed by the system.

Yet another object of the present invention is to provide a system giving individual golfers information related to distances between their ball and various golf course obstacles and targets.

These and other objects are accomplished by providing a system that includes at least one golf ball including a transmitter that transmits an electromagnetic signal, at least two electromagnetic signal receivers, a coordinate system to map out the golf course, a processor which performs triangulation calculations to determine location, and at least one display unit which displays the location processed by the processor.

After being hit, the golf ball transmits an electromagnetic signal which is received by the electromagnetic receivers. The electromagnetic receivers, then determine 1) the identification of the particular golf ball and 2) the angle of arrival of the signal and/or the distance between the golf ball and the electromagnetic receivers. The electromagnetic receivers send this data to the processor which then uses conventional triangulation methods to generate position coordinates for the particular golf ball. These position coordinates belong to the coordinate system mapping out the golf course, or parts thereof. The processor causes a visual and/or audio display of the location of the golf ball, for example providing the location coordinates and/or a terrain display with the location identified, and/or audio location information using landmarks on the golf course.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
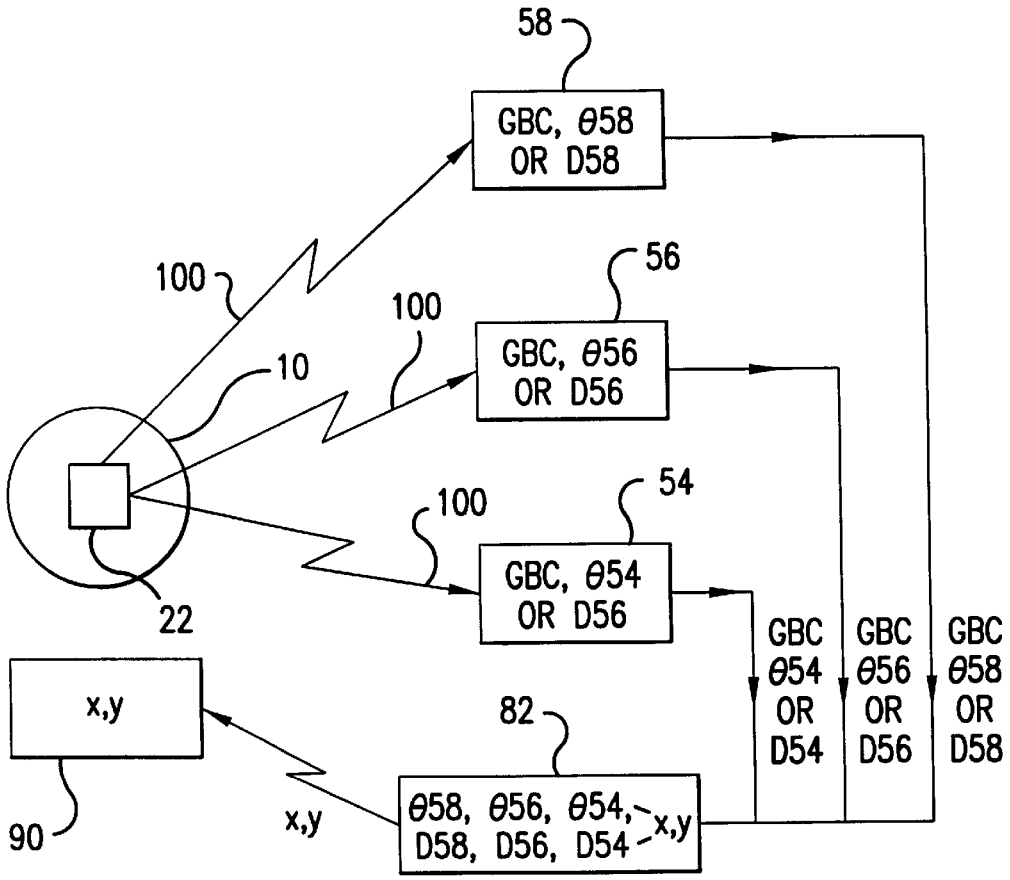
FIG. 1 is a block diagram of the general relationships between various elements of the present invention.

Referring now to the drawings, wherein like reference numerals designate identical or corresponding parts throughout the several views, and more particularly to FIG. 1 thereof, there is illustrated a golf ball 10 comprising an electromagnetic transmitter 22 that transmits an electromagnetic signal 100. The electromagnetic signal 100 is received by electromagnetic receivers 54, 56 and 58 that determine 1) a golf ball code GBC for identification of golf ball 10 and 2) angles of arrival θ54, θ56 and θ58 of signal 100 as taught for example in Krilanovich (U.S. Pat. No. 4,229,740) and Rackley (U.S. Pat. No. 4,742,357) both incorporated as reference herein, and/or distances D54, D56 and D58 between the golf ball 10 and the receivers 54, 56 and 68 as taught for example in Bates (U.S. Pat. No. 3,886,553), U.S. Pat. No. 4,742,357 and Sanderford et al (U.S. Pat. No. 4,799,062) all three incorporated as reference herein. Electromagnetic receivers 54, 56 and 58 then transmit this data to processor 82 that performs triangulation calculations using θ54, θ56, θ58, as taught for example in U.S. Pat. No. 4,229,740, or using D54, D56, D58 as taught for example in U.S. Pat. No. 3,886,553 and U.S. Pat. No. 4,799,062, to generate global coordinates X,Y belonging to a coordinate system (shown in FIG. 5) mapping out a golf course (shown in FIG. 5). The processor then transmits global coordinates X,Y to display unit 90 which can be viewed by the golfer playing golf ball 10.

Figure 2A:
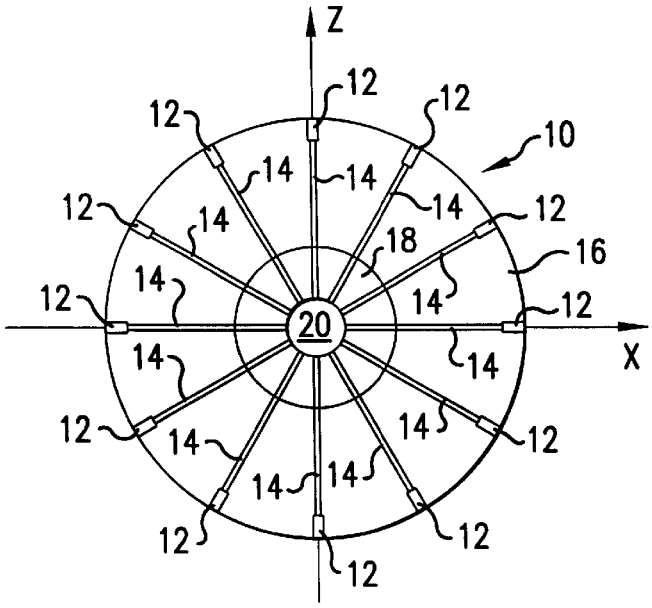
FIG. 2*a* is a cross-sectional view of the X–Z plane of a first embodiment golf ball according to the present invention.
Figure 2B:
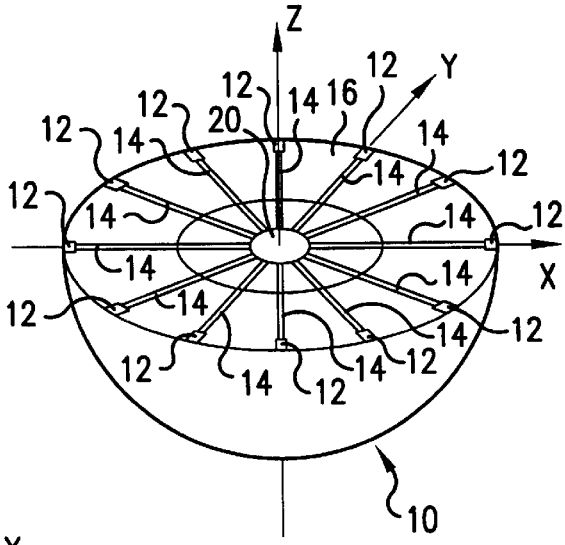
FIG. 2*b* is a cross-sectional view of the X–Y plane of a first embodiment golf ball according to the present invention.
Figure 2C:
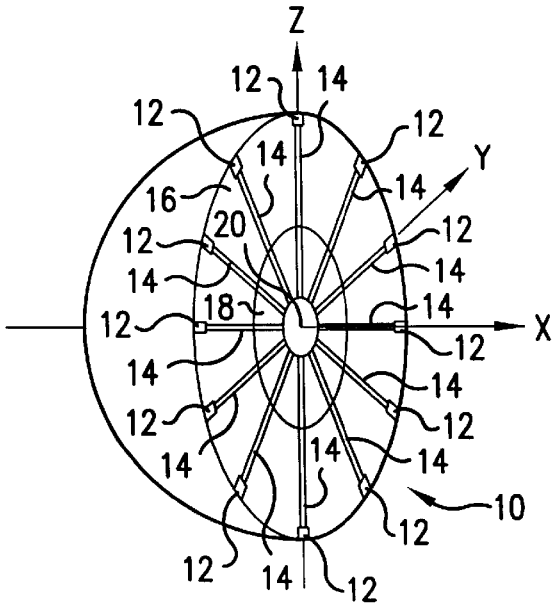
FIG. 2*c* is a cross-sectional view of the Y–Z plane of a first embodiment golf ball according to the present invention.

A first embodiment of the present invention is fully disclosed in connection with FIGS. 2–8 as discussed below. FIGS. 2A–C illustrate a golf ball 10 including thirty infrared emitting diodes 12 which are evenly distributed over three perpendicular planes namely the X–Z, Y–Z, and X–Y planes. In this first embodiment, a 30° angle separates two consecutive diodes of a same plane. However, other distributions of the diodes would work within the scope of the present invention. Each infrared emitting diode 12 is connected via connecting wires 14 to an electronic chamber 20. Golf ball 10 comprises three concentric parts, namely an outer member 16, an inner member 18, and the electronic chamber 20. Outer member 16 can be made of a shock absorbing synthetic material, and inner member 18 can be made of a harder material to protect the electronic chamber 20. Furthermore, electronic chamber 20 can be filled with a resin embedding any electronic components part of electromagnetic transmitter 22, thereby keeping them from moving or vibrating. Golf ball 10 can also be enveloped with a thin protective cover (not shown) transparent to infrared radiation.

The content of Honey et al (U.S. Pat. No. 5,564,698) is specifically incorporated by reference herein. This patent teaches an electromagnetic transmitting hockey puck including 20 infrared emitting diodes powered by an electronic circuit. Electromagnetic transmitter 22 can be essentially the same as the one taught in U.S. Pat. No. 5,564,698 modified to fit in a golf ball with a weight not more than 45.93 gm and a diameter not less than 42.67 mm, as required by the rules of golf.

Other embodiments of the present invention comprise electromagnetic transmitter working at different frequencies. For example, radio frequencies can be generated using oscillating circuits and antennas similar to the one taught in U.S. Pat. No. 5,423,549 incorporated as reference herein. Furthermore, the electromagnetic transmitter of the present invention can comprise a signal modulator for frequency modulation, and/or amplitude modulation, and/or phase modulation and/or spread spectrum modulation circuits. For example, the present invention can work with a similar signal modulator as taught in U.S. Pat. No. 4,799,062, and U.S. Pat. No. 4,742,357.

Figure 3:
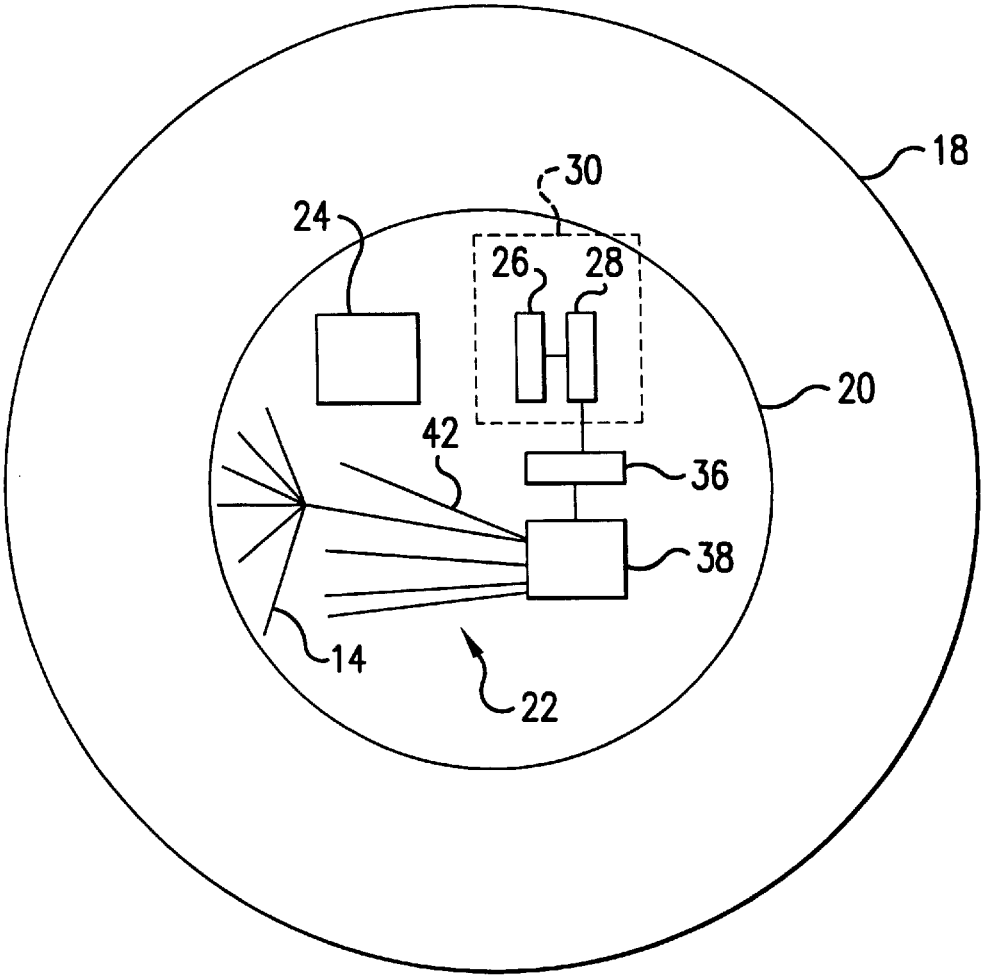
FIG. 3 is a block diagram of the electronic circuit located inside a first embodiment golf ball according to the present invention.

FIG. 3 illustrates a block diagram of the electromagnetic transmitter 22 located inside electronic chamber 20. Electromagnetic transmitter 22 comprises a power source 24, which can be a battery or a combination of batteries. Power source 24 can also be rechargeable by induction or electromagnetic radiation. Electromagnetic transmitter 22 further comprises an ON/OFF switch 30 comprising a shock sensor 26 to close the switch and a first timing circuit 28 to open it after a time T1, for example after 20 seconds. Such shock sensors and timing circuit combination are known to persons of ordinary skills in the art. For example, the shock sensor can be made of a piezoelectric material as taught in FR 2616335. Another possibility, taught in U.S. Pat. No. 5,564,698 and incorporated as reference herein, would be to use a thin metal wire in close proximity to the inside wall of a metal cylinder. The metal wire moving under a shock and touching the metal cylindrical wall closes the switch momentarily, and an edge detector circuit closes the switch until the timing circuit opens it.

The advantage of using such an ON/OFF switch is to increase the lifetime of the power source 24. As discussed below, to locate a golf ball, the system of the present invention only needs an electromagnetic signal for a very short time, i.e. a few seconds. It is, therefore, not necessary to keep the electromagnetic transmitter 22 powered constantly, nor for a relatively long time. To save power, electromagnetic transmitter 22 may further include a second timing circuit 36 to delay the transmission of the electromagnetic signal during a time T2. This delay is advantageous in a system of the present invention which only requires an electromagnetic transmission after the golf ball has come to rest. For example, and assuming that most golf balls do not move for more than several seconds after being hit, the secondary timing circuit 36 can be set to delay transmission of the electromagnetic signal for several seconds.

However, second timing circuit 36 is not essential for to the present invention. Instead, in one preferred embodiment, the transmitter continuously transmits an electromagnetic signal from the time the switch 30 is turned ON, i.e. when the golfer hits the ball, to the time switch 30 is turned OFF. In this case, the system can monitor the signal during the ball's flight in order to determine its flight path. The flight path can be used to interpolate the golf ball's location in the event the transmission is not received for some reason when the ball comes to rest, e.g. as may result if the ball falls in a hole or its transmission is obstructed by some obstacle. The interpolation typically will be performed on the basis of an algorithm utilizing ball flight path and perhaps also speed and acceleration, and perhaps also weather conditions (wind, temperature and humidity) depending on the degree of interpolation accuracy desired. Alternatively, interpolation tables can be empirically derived and stored for use by the processor.

Additionally, the interpolated golf ball position can be compared to the triangulated golf ball position when the golf ball signal is not lost after the ball comes to rest. Either or both of the interpolated and triangulated golf ball position can be transmitted to the player and displayed. Likewise, when the comparison indicates a large difference between the interpolated and triangulated positions, or when the golf ball signal is lost for whatever reason as above noted, a warning "low reliability" signal can be transmitted to the player accordingly.

In order to further save the energy from the power source 24, the electromagnetic transmitter 22 comprises a pulsing circuit 38, such as for example the one taught in U.S. Pat. No. 5,564,698, enabling an infrared signal to be pulsed at a pulsing frequency. Such pulsing circuits are well known to persons of ordinary skills in the art. In a first embodiment of the present invention, the golf ball code GBC is the pulsing frequency. The electromagnetic receivers thus identify each golf ball by identifying the pulsing frequency. By providing each golf ball with a unique pulsing frequency, the system of the present invention can identify each golf ball individually.

Other golf ball codes are possible. For example, pulsing circuit 38 can be a duration modulation circuit providing a pulse of signal 100 for a unique duration. In this case, the GBC is the pulsing duration. Alternatively, pulsing circuit 38 can be an amplitude modulating circuit providing a pulse of signal 100 with a unique amplitude. In this case, the GBC is the pulsing amplitude. Also, pulsing circuit 38 can be a code modulation circuit providing a sequence of ON/OFF pulses of signal 100. In this case, the GBC is the pulsing sequence. Other coding schemes include frequency modulation, phase modulation or spread spectrum modulation of a carrier signal, all of which, along with the ones described above, are known to a person of ordinary skills in the art of data transmission. For example, some of these techniques are discussed in Chapter 13 of *The Art of Electronics* (P. Horowitz and W. Hill, 1989) incorporated as reference herein.

Figure 4:
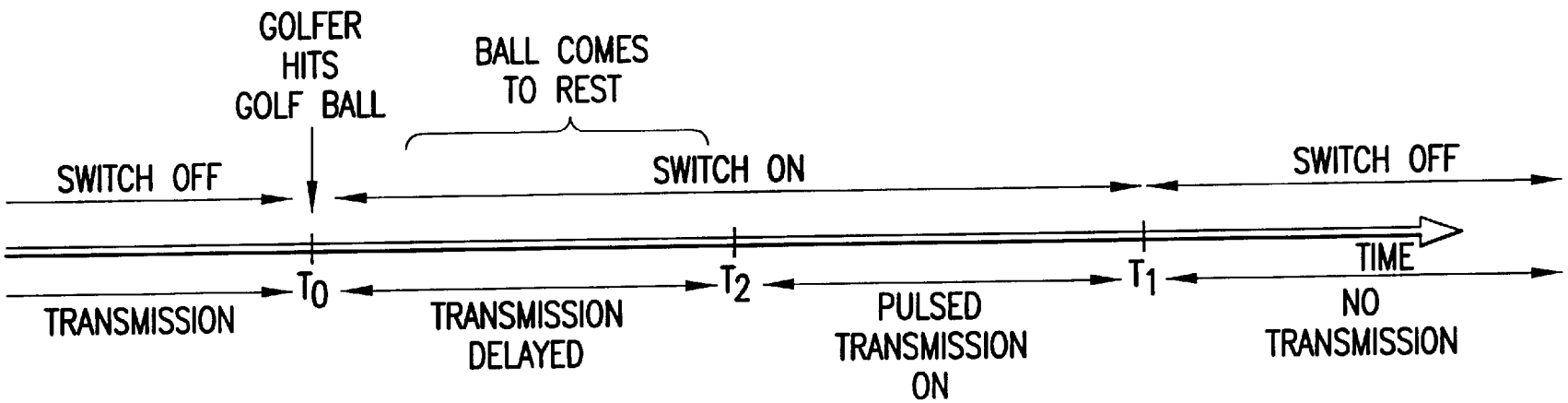
FIG. 4 is a time line indicating the status of the ON/OFF switch 30 and the transmission status according to the first embodiment of the present invention.

The time line of the above description is illustrated in FIG. 4. Time T0 is defined as the time when a golfer hits a golf ball. Before T0, switch 30 is in the OFF position and no electromagnetic signal is transmitted. The switch 30 is turned ON at T0 by the shock sensor 26 and stays ON until the first timing circuit 28 turns it OFF at T1. From T0 to T2, the switch 30 is therefore ON, however, second timing circuit 36 delays the transmission since the golf ball is typically moving during most of that time. The golf ball typically comes to rest at some time just before T2. At T2, second timing circuit 36 stops the delay of the transmission and a pulsed electromagnetic signal is being transmitted until T1. At T1 the switch 30 is turned OFF by the first timing circuit 28 thereby terminating the transmission.

Finally, electromagnetic transmitter 22 comprises leads 42 to connect with connecting wires 14 and with the infrared emitting diodes 12. In this first embodiment, each lead 42 is connected to six emitting diodes 12 connected in series via six connecting wires 14.

Figure 5:
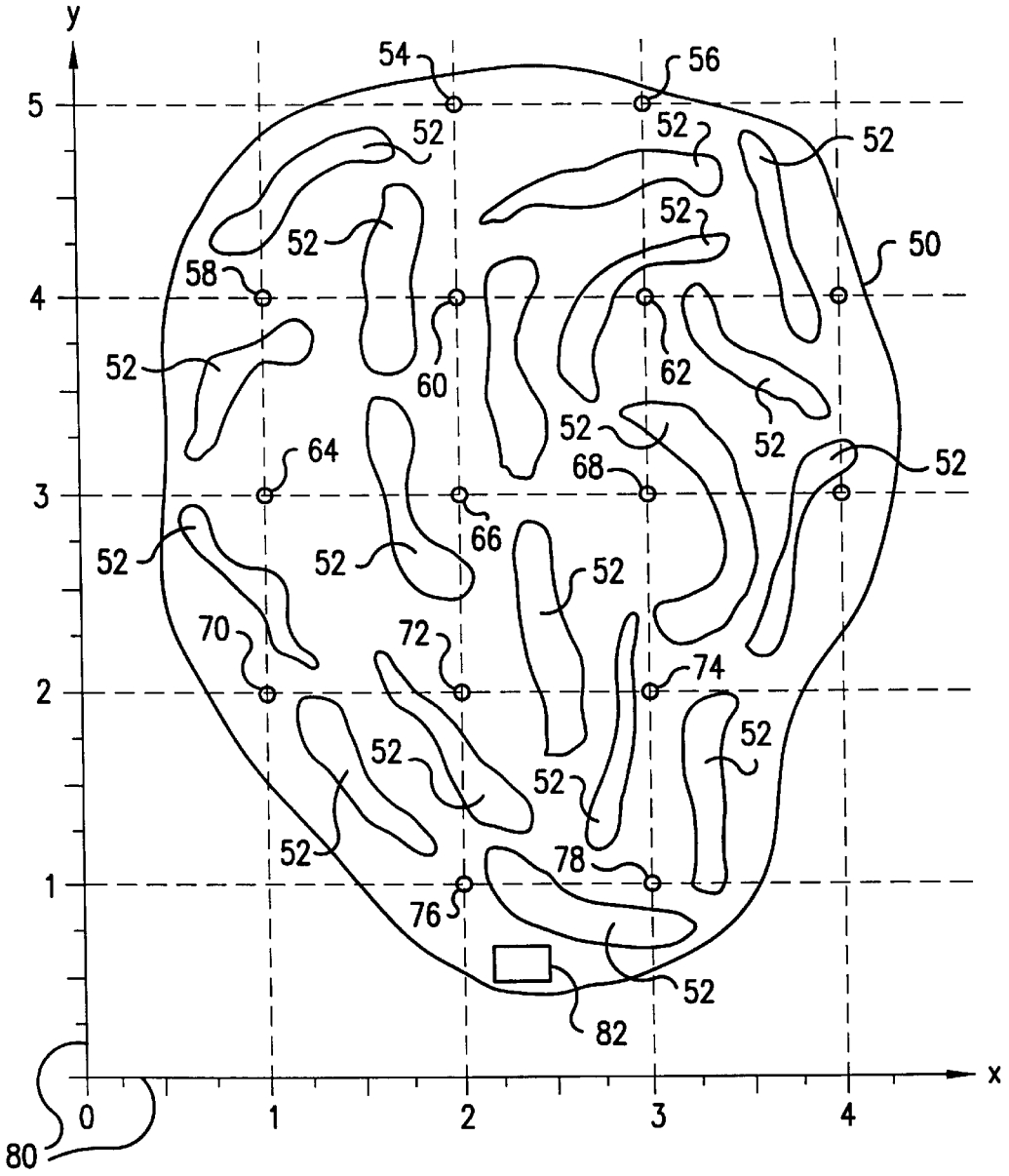
FIG. 5 is a schematic top view of a first embodiment golf course according to the present invention.

FIG. 5 illustrates a schematic view of a golf course 50 with golf course holes 52 and comprising an array of electromagnetic receivers 54–78. The golf course 50 is mapped out by an X–Y coordinate system 80.

In this first embodiment, the electromagnetic receivers 54–78 are elevated directional finders. Elevated directional finders 54–78 comprise an angle of arrival detection system to measure the angles of arrival θ54-θ78 of the electromagnetic signal 100. For example, a detection system similar to the one taught in U.S. Pat. No. 4,229,740 and U.S. Pat. No. 4,742,357 and appropriately modified can be used for the present invention. It is also possible to use distance finders measuring the time of arrival of signal 100 at the distance finder, as disclosed for example in U.S. Pat. No. 3,886,553, U.S. Pat. No. 4,742,357 and U.S. Pat. No. 4,799,062. These technologies, namely angle of arrival and time of arrival measurements, are well known to persons skilled in the art and may be appropriately modified for use in the system of the present invention. For example, elevated directional finders 54–78 can comprise an array of infrared sensors. The array of infrared sensors spans a 360 degree field of vision, but each of the sensor receives a signal through a narrow window spanning only a fraction of the array's field of vision, for example a 1 degree span per infrared sensor. Alternatively, an infrared detection similar to the one taught in Mueller (U.S. Pat. No. 5,641,963), or an optical apparatus as disclosed in Kovama (U.S. Pat. No. 5,751,409), both incorporated as reference herein, and appropriately modified can be used in the present invention.

Elevated directional finders 54–78 further comprise an identification circuit for measuring the pulsing frequency of the signal so as to identify the golf ball by a particular pulsing frequency. Alternatively, as discussed above, the electromagnetic signal can be frequency modulated, and/or amplitude modulated, and/or phase modulated and/or spread spectrum modulate. In these embodiments, the identification circuit identifies the golf ball by a particular modulation. Such identification circuits are well known to persons of ordinary skills in the art. For example, the present invention can work with an appropriately modified identification circuit similar to the one taught in U.S. Pat. No. 4,742,357, which is incorporated as reference herein and which discloses an electronic control unit that identifies a vehicle identification number.

Elevated directional finders 54–78 can be mounted on a pole or a post, or attached to a tree or a lamp post, or any elevated fixture. Preferably, they should be mounted so that their field of vision is as wide as possible. In order to increase the signal to noise ratio, elevated directional finders 54–78 can be protected from infrared radiation from the sun by providing them with an infrared "cap". This infrared "cap" can either reflect infrared radiation from the sun or absorb it, as long as the infrared radiation from the sun does not reach the sensors of the elevated directional finders.

In FIG. 5, the number of elevated directional finders is 15, but the present invention could work with a greater or a lesser number than 15. The minimum number of elevated directional finders is 2, however, in some situations where the golf ball is aligned with the two elevated directional finders, a third elevated directional finder is necessary to locate the golf ball. Because of the limited range of the infrared signal and because of obstacles possibly hiding the golf ball from the elevated directional finders, it is preferable to use an array of many. Furthermore, the directional finders need not be uniformly placed on the golf course, but instead can be spaced in relation to the peculiarities of each hole. However, other embodiments including a radio frequency transmission, for example similar to U.S. Pat. No. 4,799,062 and U.S. Pat. No. 4,742,357, can work with a limited number of receivers.

FIG. 5 also shows processor 82 which may be located anywhere on the golf course, and even outside the golf course, provided that control unit 82 can receive data from elevated directional finders 54–78 and transmit data to the display units discussed below, either using hard-wire connections or using wireless communication.

Figure 6:
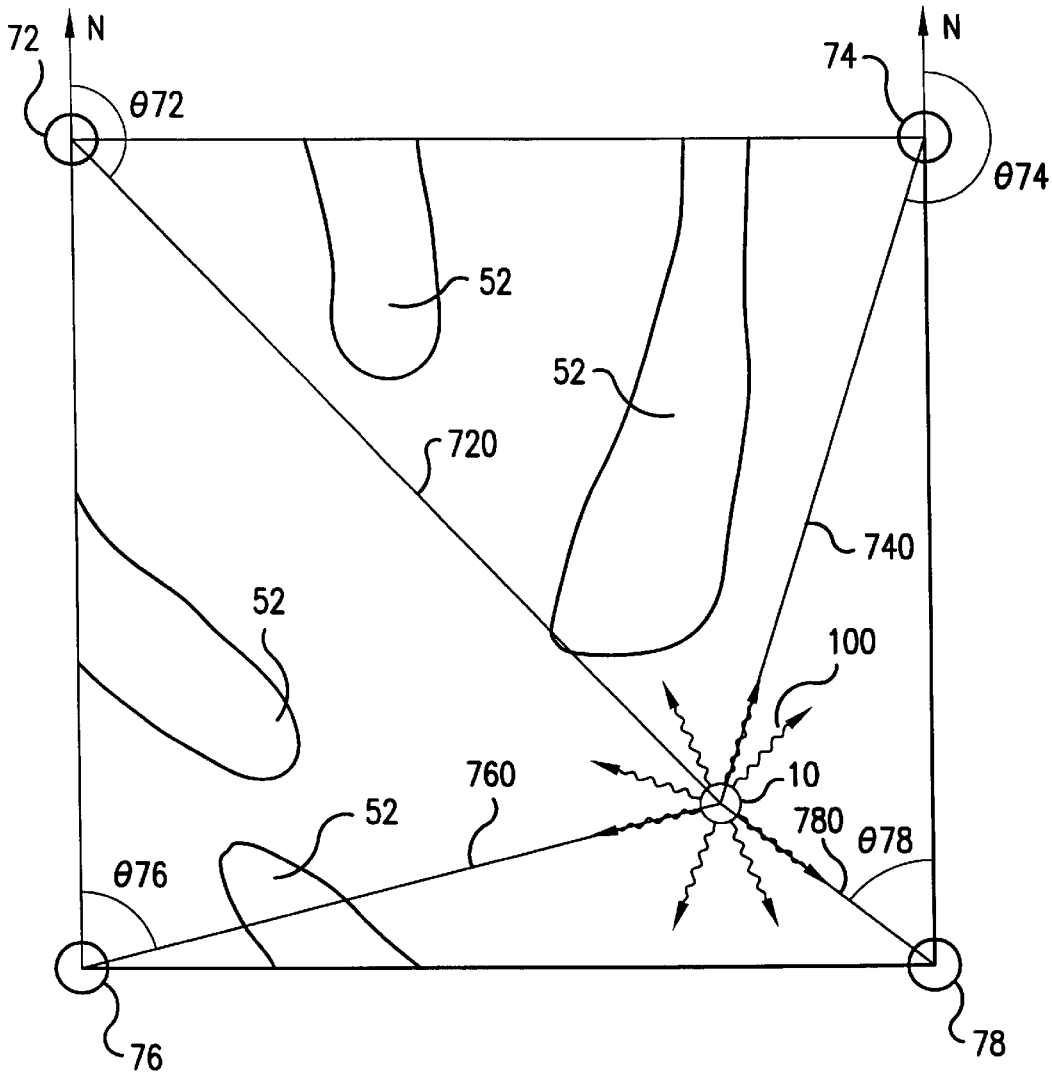
FIG. 6 is a schematic top view of a portion of a first embodiment golf course according to the present invention.

FIG. 6 illustrates a portion of the golf course 50 corresponding to X from 2 to 3 and Y from 1 to 2 of FIG. 5. Golf ball 10 is at rest and is transmitting a pulsed coded infrared signal 100. Elevated directional finders 72, 74, 76, 78 determine 1) the signal amplitude (SA) of the pulsed coded infrared signal 100, 2) the golf ball code (GBC), i.e. the pulsing frequency of signal 100, identifying golf ball 10 and 3) the angles θ72, θ74, θ76 and θ78 between the directions 720, 740, 760, 780 and the North direction. Here, the North direction is chosen arbitrarily. Any predetermined direction can be chosen as long as all elevated directional finders use the same predetermined direction. Finally, elevated directional finders 72–78 transmit this data, specifically the signal amplitude SA, the identifying code GBC and the angles θ72, θ74, θ76 and θ78, to the control unit 82.

Figure 7:
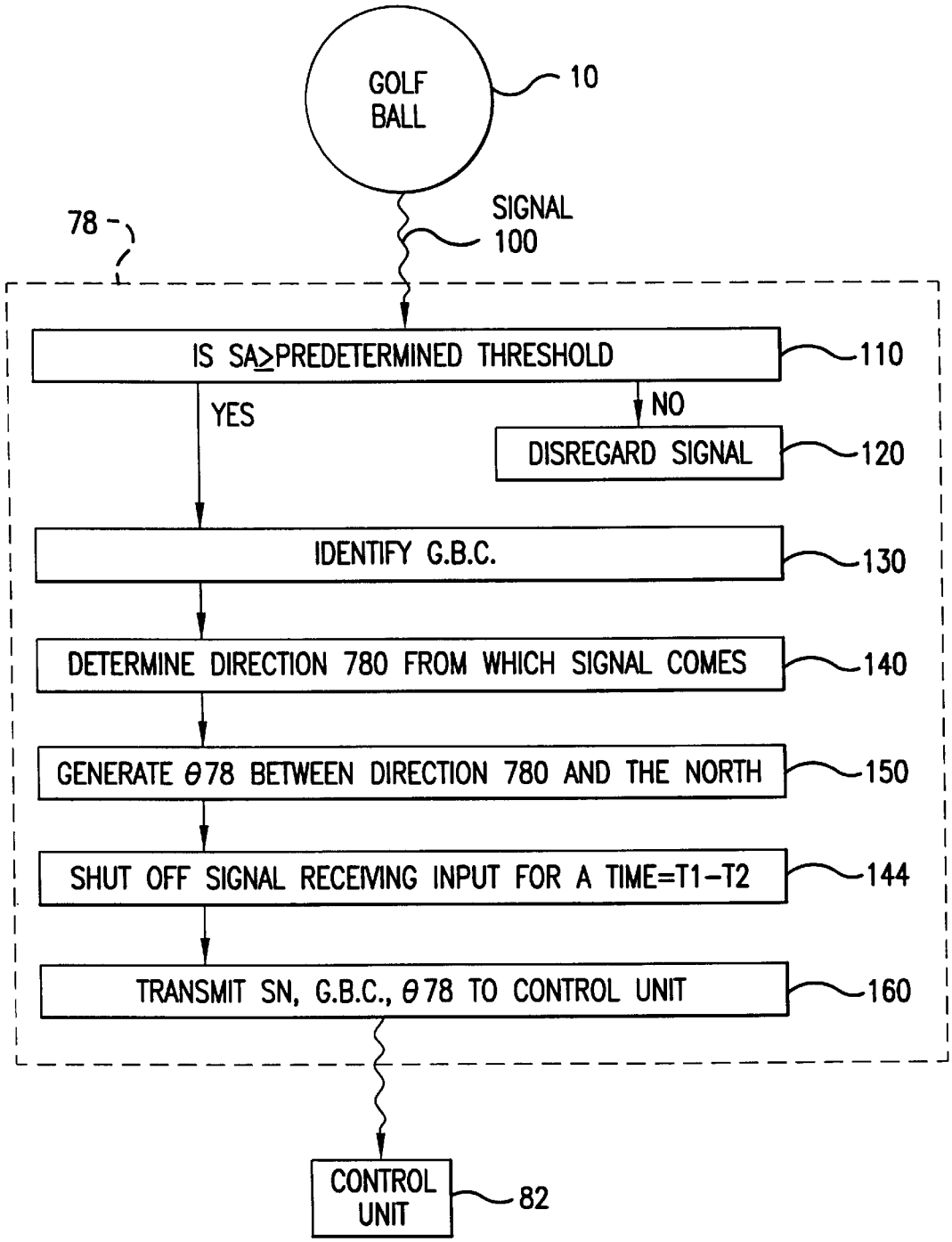
FIG. 7 is a flow chart indicating the steps performed by the first embodiment elevated directional finder according to the present invention.

FIG. 7 illustrates the steps taken by elevated directional finders 78 after receiving an infrared signal 100 from golf ball 10 through a signal receiving input (not shown). In step 110, the elevated directional finder 78 receives a pulsed coded infrared signal 100 from golf ball 10. Finder 78 first determines whether the signal amplitude SA of signal 100 is greater than a predetermine threshold. If SA is less than the predetermine threshold then finder 78 performs step 120 and disregards the signal. If SA is equal to or greater than the predetermined threshold, then finder 78 performs step 130 and identifies golf ball 10's code GBC. Step 120 is used to eliminate any background infrared radiation that finder 78 receives. Finder 78 then determines in step 140 the direction 780 from which golf ball 10 is transmitting the signal 100. Since signal 100 is transmitted during a time equal to T1 minus T2 as discussed above in relation to FIG. 3, steps 110–140 can be performed during that time, which can be made as long as 10 seconds. While the above sequence of steps 110–140 is shown in FIG. 7, however other sequences can be used.

After determining direction 780, finder 78 then shuts off the signal receiving input in step 144 for a time equal to T1 minus T2 so that the same signal 100 is not analyzed more than once by finder 78.

In step 150, the finder 78 generates angle θ78 between direction 780 and the North direction. Finally, step 160 is performed and finder 78 transmits the data comprising the signal amplitude SA, the golf ball identifying code GBC and the angle θ78 to the processor 82. This data transmission can be performed by wireless communication or by wired transmission.

Figure 8:
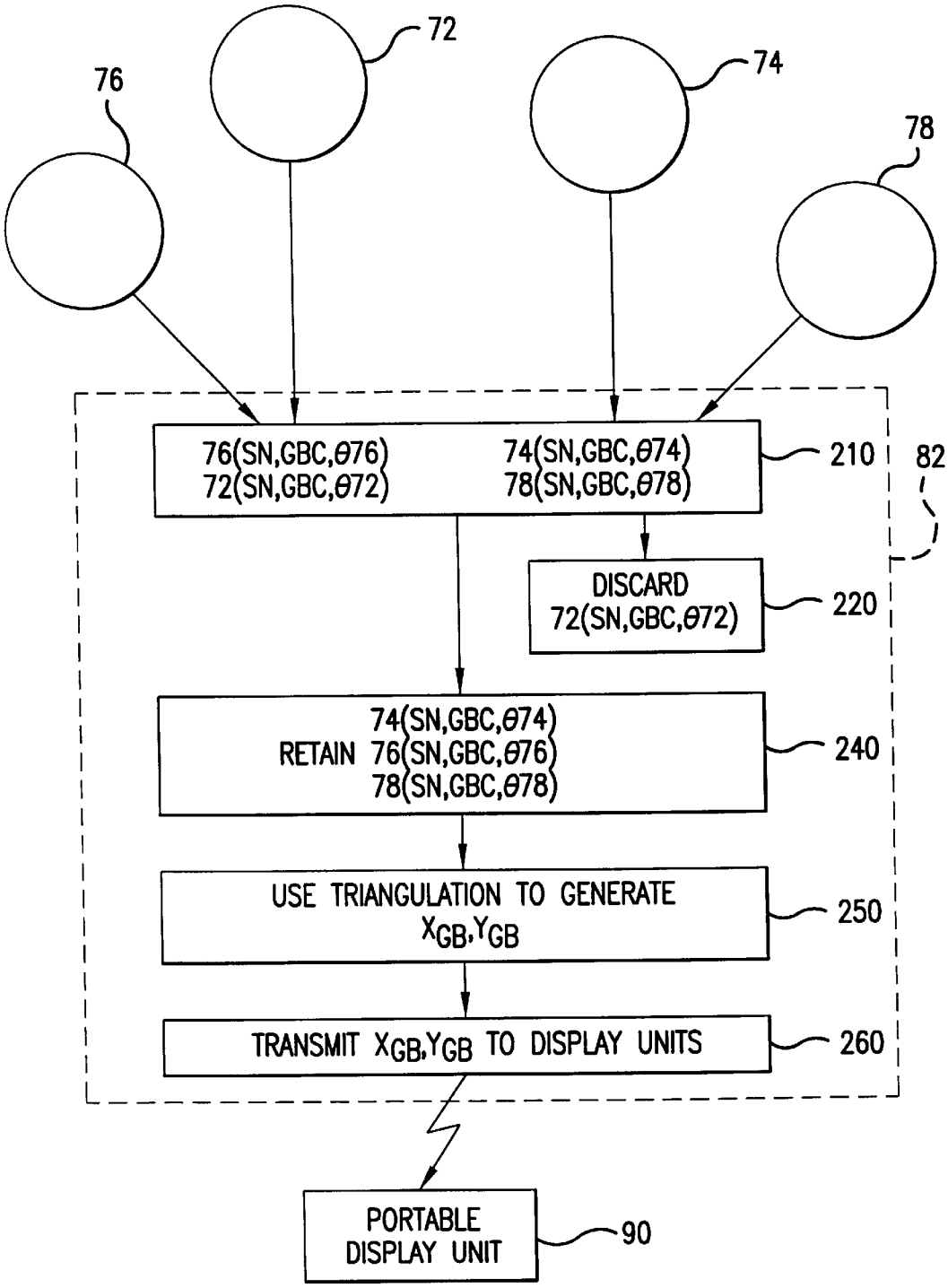
FIG. 8 is a flow chart indicating the steps performed by the first embodiment control unit according to the present invention.

FIG. 8 illustrates the steps taken by processor 82 after receiving data in step 210 from elevated directional finders 72–78. As noted above, in relation to FIG. 6, the pulsed coded infrared signal 100 can be received by several elevated directional finders 72–78. However, because of step 110 of FIG. 7, only the elevated directional finders, receiving a signal with a signal amplitude SA greater than or equal to a predetermined threshold, transmit data to the processor 82. Step 110 is essentially a first signal selecting step, so that processor 82 is not burdened by too much data, but only receives the data corresponding to signals with good signal amplitudes. Alternatively, of course, the raw data, unprocessed by the receivers, can be sent to the processor 82 for processing by processor 82. Since the processor 82 only requires three angles to generate global coordinates, processor 82 retains, in step 240, only the three sets of data corresponding to the best three signal amplitude. In other words, step 240 is a second signal selecting step. The rest of the sets of data can be discarded in step 220. Using the three retained angles θ74, θ76, and θ78 and standard triangulation calculations as taught in U.S. Pat. No. 3,886,553, U.S. Pat. No. 4,229,740, U.S. Pat. No. 5,641,963 or U.S. Pat. No. 4,799,062, processor 82 generates in step 250 location coordinates $X_{GB}$ and $Y_{GB}$ for golf ball 10 corresponding to the location of golf ball 10 relative to the coordinate system 80 shown in FIG. 5. Finally, processor 82 transmits the location coordinates to display unit 90. Display unit 90 can be a portable display unit with visual and/or audio outputs displayed to the golfer using golf ball 10. The transmission of the location coordinates for golf ball 10 $X_{GB}$ and $Y_{GB}$ to portable display unit 90 can be performed using wireless communication.

Display unit 90 can display a map of golf course 50 and using the coordinate system 80 and the location coordinates $X_{GB}$ and $Y_{GB}$, display unit 90 indicates the location of golf ball 10 directly on the golf course map by a blinking dot or any other equivalent means for indicating the location of golf ball 10 on a golf course map. For example, a similar method as taught in Green et al (U.S. Pat. No. 4,791,572) included as reference herein, could be appropriately modified and used in the present invention. Additionally, display unit 90 can also display the position coordinates themselves.

Alternatively, display unit 90 can display the position coordinates by themselves, for example on a pager unit.

Advantageously, the coordinates of various obstacles and targets of the golf course 50 can also be stored in a memory of the display unit 90, so that display unit 90 can display distances between these landmarks and the golf ball 10. Actual distances between the landmarks, one of which may be the pin hole itself, and the ball can also be calculated and displayed themselves to help the golfer with golf club selection. For example, using a screen pointing device, the golfer can point to these landmarks and make the display units display the distances between the designated landmarks and the golfer's ball.

Additionally, the processor 82 can store in memory speech synthesized data and can transmit to the display unit location information based on the location of the ball relative to the landmarks of the golf course. For example, the display unit can output the following audio signal: "your ball is located fifty feet from the left sand trap in a North-West direction".

In a second embodiment of the present invention, an electromagnetic transmitter located inside a golf ball transmits an electromagnetic signal in the radio frequency part of the electromagnetic spectrum using a conventional radio frequency circuit with an antenna, for example as disclosed in U.S. Pat. No. 5,423,549, or a combination of antennas. As in the first embodiment, the identification of a particular golf ball can be performed using a particular pulsing frequency, amplitude, duration or pulse sequence. Furthermore, the signal can be frequency modulated, and/or amplitude modulated, and/or phase modulated, and/or spread spectrum modulated, for example as in U.S. Pat. No. 4,799,062. In this embodiment, the electromagnetic receivers comprise radio frequency receivers and perform the same functions as described in the first embodiment of the present invention. The electromagnetic receivers can measure either the angle of arrival as taught in U.S. Pat. No. 4,229,740, U.S. Pat. No. 4,742,357 or the time of arrival as disclosed in U.S. Pat. No. 3,886,553, U.S. Pat. No. 4,742,357, and U.S. Pat. No. 4,799,062. The processor and the display units also perform the same functions as described in the first embodiment of the present invention.

In a third embodiment, the system of the present invention further comprises a mobile position location device on the golf cart being driven by the player using the golf ball, or on the player himself/herself. This mobile position device typically will include a transmitter transmitting a signal similar to that transmitted by the golf ball, but with different modulated identification information, with the "player signal" being received by the receivers and used to calculate player or golf cart position coordinates in the same manner as golf ball position coordinates are generated.

Alternatively, the golf cart/player mobile position location device can be a Global Positioning System (GPS) unit. For example, a GT Plus Oncore Receiver by MOTOROLA can be appropriately modified for the present invention. The GPS unit receives GPS coordinates and can either translate them into golf cart/player coordinates $X_{GC}$ and $Y_{GC}$ belonging to the coordinate system 80 and then transmit the golf cart coordinates to the processor, or transmit the GPS coordinates to the processor 82 for translation into golf cart coordinates which can then be sent to the display unit.

In this embodiment, it is further possible for the processor to store predetermined instructions in a memory, selected in relation to the relative coordinates of the golf cart and the golf ball, transmit these instructions to the display unit thereby instructing the golfer what direction to drive the cart to find the ball. Similarly, such instructions can be given relative to existing landmarks on the golf course and/or the particular hole being played, thereby to automatically guide the player to his/her ball. To assist in such guiding, the golf cart or player can be equipped with a compass, for example, and the instructions to the golfer can inform the golfer of a compass heading and a distance to be followed at regular intervals. These driving instruction can be displayed visually or audibly. Of course, in the case of audible direction, the driving instructions being stored in a memory of processor 82 are speech synthesized. For example, the audio output can inform the golfer of where the ball is located relative to landmarks pre-programmed into the processor, e.g. "The ball is located 5 yards behind the green and 6 yards to the right of the green", or "The ball is located 10 yards to the left of the fairway and 20 yards beyond the 100 yard marker", and then give instruction to the golfer as to what path to take to find the ball. For example, "Please proceed 100 yard toward the pin, then turn right."

Advantageously, because the processor is tracking the golf cart position as it moves, these driving instructions can be regularly updated as the golfer makes his/her way toward the ball. For example, the display unit can output "you're about to turn right . . . please turn right . . . proceed 50 yard . . . you're about to turn left . . . please turn left . . . you're ball is 35 yards ahead . . ." Similar systems are optionally provided in automobiles and could be appropriately modified for the present invention, for example a navigation system is offered in some LEXUS 1998 GS 400 models.

The present invention also can be used to facilitate golf course management. Information such as the time between strokes can be stored in a processor memory and utilized to identify slow play so that corrective action can be taken by management to speed up play. In addition to tracking time between strokes, distance from the pin for each hole and/or distance from the fairway and/or putting green, and/or whether and when a ball is hit out of bounds, can easily be determined and combined with time between strokes information to rate play as being too slow and requiring intervention. This is particularly true where slow play for one player is caused by slow play by a preceding group of players as might be evidenced by a long time between strokes but otherwise good ball position (the ball is on or close to the fairway or green). In the latter case, corrective action may be taken with respect to the preceding group of players in addition to or instead of the lagging group.

As one example of a simple algorithm for judging slow play, the net forward progress for each shot can be determined. Net forward progress can be determined by breaking down each shot into orthogonal components, a first component (A) being the distance traveled in a direction parallel to the centerline of the fairway and a second orthogonal component (B) corresponding to the distance traveled along a line perpendicular to the fairway centerline, for each shot. Then, a rating factor can be derived by subtracting B from A for each shot, and adding the difference for each shot of each hole, thereby for each hole obtaining a forward progress factor. The smaller the factor, the slower is the play, whereby slow play can be detected. In addition, since different holes have different levels of difficulty, the forward progress factor for each hole may be weighted based on the degree of difficulty of the hole, or otherwise compared with average forward progress factors stored in a database. Forward progress factors, whether or not weighted, may be averaged over any desired number of holes to derive a play quality factor which may be used by the course operator either to take remedial action when play is excessively slow, and also to reward a player for "good" play. Furthermore, in determining the play quality factor, selected strokes, such as putts, can be excluded from the computation.

As another example of how to judge quality of play, each hole of the golf course, and its surrounding area, can be divided into zones and each zone assigned a number or point count indicative of whether a ball in that zone is a bad shot or a good shot. For each shot, a number indicative of whether the shot is good or bad can be obtained depending on the zone in which the ball comes to rest. For example, a shot down the middle of the fairway, can be assigned a high number corresponding to the zone it comes to rest, and a shot far off the fairway landing in a zone assigned a low number or point count can be given a corresponding low number, and a shot out of bounds can be assigned an even lower number or zero. Accordingly, it is possible to store in a database zone templates for each hole, with corresponding quality numbers associated with each zone of each template. Further each hole may have plural zone templates associated therewith, wherein the location and shape of the zones and/or the point counts assigned thereto can be determined for each template in dependence on the position of the ball, and the zones can be made as large or small as may be desired, with the only limiting factor being resolution of the position location by the triangulation calculation. In this way, a good shot following a bad shot can be rewarded and topography and course obstacles can be taken into account by assigning points to each shot based on the zone in which the ball comes to rest at each shot and the point count assigned to that zone for that shot. Then, the total number of points realized for all the strokes for each hole, or for only selected strokes, since it may be desirable to exclude certain strokes in computation of a play quality factor, for example to exclude putting strokes, can be divided by the number of shots for that hole to derive the play quality factor. The play quality factor can be weighted based on the difficulty of the hole, as will be predetermined, typically by the course operator, and averaged over a number of holes. A running average may be maintained over a predetermined number of holes. When the weighted and/or averaged quality factor falls below a predetermined threshold, as may easily be detected by the processor, slow play can be determined, and remedial action taken, such as an alarm sounded and a warning issued to the player. On the other hand, when the weighted and/or averaged quality factor is above a predetermined threshold, the player can be rewarded for example, by being given a gift or a rebate.

To determine slow versus fast or average play, a database can be obtained, typically by the course operator, for typical play times or play quality factors for each hole of a golf course, by players with different handicaps. Monitored time between strokes can be compared to the database for players of comparable handicap and an alarm sounded and/or displayed identifying slow players. The alarm can be audio or visual or both. Alternatively, or in addition thereto, an alarm can be sounded when the time between strokes exceeds a predetermined value over a predetermined number of strokes. Similarly, the determined play quality factor or an average thereof, for example, is indicative of the speed of play, and an alarm can also be sounded when it is determined that the play quality factor or average thereof is below a predetermined threshold Likewise, if the play quality factor or average thereof is below a predetermined threshold and it is further determined that time of play also exceeds a predetermined threshold, an alarm or warning can be sounded, for example when a running average of monitored time between strokes exceeds a predetermined threshold. The alarm can be transmitted to the player or displayed on a local display associated with the player depending upon where the calculations are performed, to indicate that slow play has been detected and to request that play be speeded up. When slow play is detected by a central processor, a course operator personnel may be sent to observe the identified slow player(s) and take whatever corrective action and/or warning may be desired. Furthermore, regardless of whether slow play occurs, information such as total time between strokes and/or play quality factors can be determined either by the central processor or a local processor and communicated to the player as an interesting statistic by which the player can monitor his level of play. Additionally, such information may be used in conjunction with total number of strokes to determine a player's handicap.

The present invention can also be used as an instructive tool for the player and his instructor. For example, a paper printout or video display can be coupled to the processor to produce a visual record showing the player where each shot landed during play on a hole or an entire round of holes. In this way, patterns can be discerned. Likewise, a golf ball transmitter which transmits signal from the moment of impact till coming to rest can be employed, and ball in flight progress for each stroke of each hole or only selected strokes monitored, stored and displayed, either in a print out or in a video display, either during or after play, so that slice and hook tendencies can be observed and corrected.

The present invention thus also includes a computer-based product which may be hosted on a storage medium and include instructions which can be used to program a general purpose microprocessor or computer to perform processes in accordance with the present invention. This storage medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions. Furthermore, the processing performed in implementing the invention may be performed entirely by a central computer coupled to the electromagnetic signal receivers, or may be distributed between a central computer and a hand held or portable (local) computer, e.g., a PALM PILOT computer, associated with the golf player. For example, the processing load of the central computer can be limited to ball location processing and the result of such processing and time of shot information can be transmitted to a local computer associated with the golf player. The local computer, appropriately programmed, would then would have all the information necessary to process the information and output whatever data is desired, such as ball rest positions after strokes, ball in-flight progress, times between strokes, play quality factors, etc. Alternatively, various of the processing functions can be performed at the central processor. Thus, references to a "processor" of the present invention are to be interpreted as including computers performing distributed processing.

The present invention further includes a data base stored in a memory and including various data fields storing the above-described data/information, including golf ball location for plural holes, time of flight information for plural shots, time between shot information, data used in calculation of play quality factors as well as the play quality factors themselves.

Numerous modifications and variations of the present invention are possible in light of the above teachings. It is therefore to be understood that within the scope of the appended claims, the invention may be practiced otherwise than as specifically described herein.

What is claimed is:

1. A golf ball locator system comprising:

a golf ball including an electromagnetic signal transmitter;

at least two electromagnetic signal receivers configured to receive an electromagnetic signal transmitted by the golf ball; and a processor coupled to the receivers and configured to receive signals from the receivers, to determine a location of the golf ball using triangulation calculations, and to output at least one signal indicating the location of the golf ball in relation to a two-dimensional area including the location of the golf ball.

2. A system as recited in claim 1, wherein said transmitter further comprises:

a shock initiated switch circuit to turn the transmitter ON; and a first timing circuit to turn the transmitter OFF.

3. A system as recited in claim 2, wherein said transmitter further comprises:

a second timing circuit configured to delay said electromagnetic transmission a predetermined time period after the transmitter has been turned ON by said shock initiated switch circuit.

4. A system as recited in claim 1, wherein said transmitter further comprises:

a pulsing circuit configured to generate said electromagnetic signal at a predetermined pulsing frequency assigned to said golf ball thereby allowing identification of said golf ball by said receivers.

5. A system as recited in claim 1, wherein said transmitter further comprises:

a modulator configured to modulate said electromagnetic signal with identification information thereby allowing identification of said golf ball by said receivers.

6. A system as recited in claim 1, wherein said processor is configured to determine at least part of the golf ball's flight path, to interpolate a position of said golf ball based at least in part on the determined flight path, and to output a signal indicative of the interpolated positions.

7. A system as recited in claim 1, wherein said receivers comprise:

an angle of arrival detection system.

8. A system as recited in claim 1, wherein said receivers comprise:

a time of arrival detection system.

9. A system as recited in claim 1, wherein said transmitter comprises:

a power source, and at least one infrared diode coupled to the power source and capable of emitting infrared radiation.

10. A system as recited in claim 9, wherein said transmitter further comprises:

a modulation mechanism configured to modulate said at least one infrared diode with identification information.

11. A system as recited in claim 1, wherein said transmitter comprises:

a radio frequency signal source.

12. A system as recited in claim 11, wherein said transmitter further comprises:

a modulation mechanism configured to modulate the radio frequency signal source with identification information.

13. A system as recited in claim 12, wherein said modulation mechanism comprises:

a frequency modulator.

14. A system as recited in claim 12, wherein said modulation mechanism comprises a spread spectrum modulator.

15. A system as recited in claim 1, further comprising:

means for determining a position of a golfer or golf cart associated with the golf ball; and means for transmitting the position to said processor.

16. A system as recited in claim 15, wherein said processor comprises:

means for generating traveling instructions based at least on the determined position of said golf cart or golfer and said golf ball location; and means for transmitting said traveling instructions to said display means.

17. A system as recited in claim 16, wherein:

said traveling instructions comprise speech synthesized driving instructions.

18. A system as recited in claim 16, wherein said processor is configured to periodically update traveling instructions during travel of the golf cart or golfer to the golf ball.

19. A system as recited in claim 1, wherein said processor is configured to determine distance to a pin based on the determined golf ball location and to output a signal indicative of the determined distance to the pin.

20. A system as recited in claim 1, wherein said processor is configured to output a signal indicative of golf ball position coordinates in relation to a pre-existing golf course map.

21. A system as recited in claim 1, wherein said processor is configured to output a signal indicative of golf ball position in relation to at least one landmark of the golf course.

22. A system as recited in claim 1, wherein said processor is configured to determine times between selected strokes and comprises a memory configured to store the determined times.

23. A system as recited in claim 22, wherein said processor is configured to add selected of the times stored in said memory and to output a corresponding sum signal.

24. A system as recited in claim 22, wherein said processor is configured to add selected of the times stored in said memory and to output a signal indicative of when a corresponding sum exceeds a predetermined value.

25. A system as recited in claim 1, wherein said processor is configured to determine a distance of ball travel in direction parallel to a fairway and a distance of ball travel in a direction perpendicular to the fairway for at least selected strokes and comprises a memory configured to store the determined distances.

26. A system as recited in claim 25, wherein said processor is configured to determine a play quality factor based on selected of the distances stored in said memory and to output a signal indicative of the determined play quality factor.

27. A system as recited in claim 25, wherein said processor is configured to determine a play quality factor based on selected of the distances stored in said memory and to output an alarm signal in dependence on the value of the determined play quality factor.

28. A system as recited in claim 1, wherein said processor comprises a memory which stores quality numbers corresponding to respective zones of a golf course, and is configured to determine the zone in which said golf ball comes to rest after being hit, to assign the respective quality number corresponding to said zone in which said golf ball comes to rest to the respective stroke, and to store the assigned quality number for at least selected strokes in said memory.

29. A system as recited in claim 28, wherein said processor is configured to output a signal corresponding to the stored quality numbers.

30. A system as recited in claim 28, wherein said processor is configured to determine a play quality factor based on selected of the assigned quality numbers and to output a signal indicative of the determined play quality factor.

31. A system as recited in claim 23, wherein said processor is configured to determine a distance of ball travel in a direction parallel to a fairway and a distance of ball travel in a direction perpendicular to the fairway for at least selected strokes and comprises a memory configured to store the determined distances.

32. A system as recited in claim 31, wherein said processor is configured to determine a play quality factor based on selected of the distances stored in said memory and to output a signal indicative of the determined play quality factor.

33. A system as recited in claim 31, wherein said processor is configured to determine a play quality factor based on selected of the distances stored in said memory and to output an alarm signal in dependence on the value of the determined play quality factor and the sum of the selected measured times.

34. A system as recited in claim 23, wherein said processor comprises a memory which stores quality numbers corresponding to respective zones of a golf course, and is configured to determine the zone in which a golf ball comes to rest after being hit, to assign the respective quality number corresponding to said zone in which a golf ball comes to rest to the respective stroke, and to store the assigned quality number for at least selected strokes in said memory.

35. A system as recited in claim 34, wherein said processor is configured to output a signal corresponding to the stored quality numbers.

36. A system as recited in claim 34, wherein said processor is configured to determine a play quality factor based on selected of the stored quality numbers.

37. A system as recited in claim 34, wherein said processor is configured to determine a play quality factor based on selected of the quality numbers stored in said memory and to output an alarm signal in dependence on the value of the determined play quality factor and the sum of the selected measured times.

38. A system as recited in claim 1, wherein said processor comprises a memory configured to store locations of the golf ball after each of plural strokes, and is configured to output said stored locations.

39. A system as recited in claim 1, wherein said processor is configured to determine at least part of the golf ball's flight path for at least one stroke and produce corresponding stroke flight data, and comprises a memory configured to store the stroke flight data.

40. A system as recited in claim 39, where said processor is configured to output signals corresponding to said stroke flight information.

41. A computer-based product storing computer instructions which can be used to program a processor to perform the following steps:

obtaining triangulation data indicative of a location of a golf ball;

processing the triangulation data to produce at least one location signal defining the location of the golf ball;

outputting the at least one location signal indicating the location of the golf ball in relation to a two-dimensional area including the location of the golf ball;

obtaining signals indicative of a position of a player playing the golf ball;

determining a location of the player playing the golf ball; and communicating traveling instructions to the player to find the golf ball.

42. A computer-based product as recited in claim 41, further storing instructions which can be used to program a processor to perform the following steps:

obtaining a modulated signal emitted by the golf ball; and identifying said golf ball from a modulation of the obtained signal.

43. A computer-based product as recited in claim 41, further storing instructions which can be used to program a processor to perform the following steps:

calculating the distance between the golf ball location and at least one landmark on a golf course; and outputting a signal indicative of the calculated distance.

44. A computer-based product as recited in claim 41, further storing instructions which can be used to program a processor to perform the following step:

outputting a signal indicative of golf ball position coordinates in relation to a pre-existing golf course map.

45. A computer-based product as recited in claim 41, further storing instructions which can be used to program a processor to perform the following step:

outputting a signal indicative of golf ball position in relation to at least one landmark of the golf course.

46. A computer-based product as recited in claim 41, further storing instructions which can be used to program a processor to perform the following step:

determining times between at least two selected strokes and storing the determined times in a memory.

47. A computer-based product as recited in claim 46, further storing instructions which can be used to program a processor to perform the following steps:

adding selected of the times stored in said memory; and outputting a corresponding sum signal.

48. A computer-based product as recited in claim 46, further storing instructions which can be used to program a processor to perform the following steps:

adding selected of the times stored in said memory to produce a corresponding sum;

comparing the sum of the added times with a predetermined value; and outputting a signal indicative of when the sum exceeds said predetermined value.

49. A computer-based product as recited in claim 41, further storing instructions which can be used to program a processor to perform the following steps:

determining a distance of ball travel in a direction parallel to a fairway and a distance of ball travel in a direction perpendicular to the fairway for at least selected strokes; and storing the determined distances in a memory.

50. A computer-based product as recited in claim 49, further storing instructions which can be used to program a processor to perform the following steps:

determining a play quality factor based on the distances stored in said memory; and outputting a signal indicative of the determined play quality factor.

51. A computer-based product as recited in claim 49, further storing instructions which can be used to program a processor to perform the following steps:

determining a play quality factor based on the distances stored in said memory; and outputting an alarm signal in dependence on the value of the determined play quality factor.

52. A computer-based product as recited in claim 41, further storing instructions which can be used to program a processor to perform the following steps:

determining for plural strokes a zone in which the golf ball comes to rest;

assigning to at least selected strokes a quality number corresponding to the respective zone in which the golf ball comes to rest; and storing the assigned quality number for at least one of said selected strokes in a memory.

53. A computer-based product as recited in claim 52, further storing instructions which can be used to program a processor to perform the following steps:

outputting a signal corresponding to the stored quality numbers.

54. A computer-based product as recited in claim 52, further storing instructions which can be used to program a processor to perform the following steps:

determining a play quality factor based on selected of the stored quality numbers; and outputting a signal indicative of the determined play quality factor.

55. A computer-based product as recited in claim 52, further storing instructions which can be used to program a processor to perform the following steps:

determining a play quality factor based on selected of the stored quality numbers; and outputting an alarm signal based on the determined play quality factor.

56. A computer-based product as recited in claim 46, further storing instructions which can be used to program a processor to perform the following steps:

determining a distance of ball travel in a direction parallel to a fairway and a distance of ball travel in a direction perpendicular to the fairway for at least one of said selected strokes; and storing in a memory the determined distances for said selected strokes.

57. A computer-based product as recited in claim 56, further storing instructions which can be used to program a processor to perform the following steps:

determining a play quality factor based on selected of the stored distances; and outputting a signal indicative of the determined play quality factor.

58. A computer-based product as recited in claim 56, further storing instructions which can be used to program a processor to perform the following steps:

determining a play quality factor based on selected of the stored distances; and outputting an alarm signal in dependence on the value of the determined play quality factor and the sum of the selected measured times.

59. A computer-based product as recited in claim 46, further storing instructions which can be used to program a processor to perform the following steps:

determining a zone in which the golf ball comes to rest for plural strokes;

assigning to at least one of said selected strokes a quality number corresponding to the respective zone in which the golf ball comes to rest; and storing the assigned quality number for at least one of said selected strokes in a memory.

60. A computer-based product as recited in claim 59, further storing instructions which can be used to program a processor to perform the following steps:

outputting a signal corresponding to the stored quality numbers.

61. A computer-based product as recited in claim 59, further storing instructions which can be used to program a processor to perform the following steps:

determining a play quality factor based on selected of the stored quality numbers; and outputting a signal indicative of the determined play quality factor.

62. A computer-based product as recited in claim 59, further storing instructions which can be used to program a processor to perform the following steps:

determining a play quality factor based on selected of the stored quality numbers; and outputting an alarm signal based on the determined play quality factor and the sum of the selected measured times.

63. A computer-based product as recited in claim 41, further storing instructions which can be used to program a processor to perform the following steps:

store in a memory locations of the golf ball after each of plural strokes; and outputting at least selected of said stored locations of the golf ball after each of plural strokes.

64. A computer-based product as recited in claim 41, further storing instructions which can be used to program a processor to perform the following steps:

determining at least part of the golf ball's flight path for at least one stroke and producing corresponding stroke flight data; and storing the stroke flight data in a memory.

65. A computer-based product as recited in claim 64, further storing instructions which can be used to program a processor to perform the following step:

outputting signals corresponding to said stroke flight information.

66. A computer-based product storing computer instructions which can be used to program a processor to perform the following steps:

storing in a first memory data field zone templates corresponding to plural holes of a golf course, each template identifying zones of play associated with respective holes; and storing in a second memory data field quality numbers associated with each zone of play.

67. A computer-based product as in claim 66, wherein:

said storing in a first memory data field comprises storing plural zone templates for each hole, each zone template for the same hole identifying respective zones of play in dependence on a location of a golf ball in play on the hole; and said second data field quality numbers associated with each zone of play for each template of each hole in dependence on the location of a golf ball in play at the respective hole.

68. A computer-based product as in claim 66, further storing instructions which can be used to program a processor to perform the following step:

storing in a third memory data field quality numbers assigned to at least selected strokes based on a zone of play in which a golf ball comes to rest at said selected strokes.

69. A computer-based product as in claim 68, further storing instructions which can be used to program a processor to perform the following step:

storing in a fourth memory data field a play quality factor derived based on the quality numbers included in the third data field.

70. A computer-based product as in claim 66, further storing instructions which can be used to program a processor to perform the following step:

storing in a fourth memory data field times between strobes information.

71. A computer-based product as in claim 66, further storing instructions which can be used to program a processor to perform the following step:

storing in a fifth memory data field times between strokes information.

72. A computer-based product as in any one of claims 66, 67, 68, 69, 70 or 71, further storing instructions which can be used to program a processor to perform the following step:

storing a further memory data field golf ball locations for plural strokes.

73. A computer-based product as in any one of claims 66, 67, 68, 69, 70 or 71, further storing instructions which can be used to program a processor to perform the following step:

storing in a further memory data base field ball flight data for plural strokes.

74. A computer-based product storing computer instructions which can be used to program a processor to perform the following steps:

obtaining, for each of plural strokes, first and second distances derived from golf ball locations obtained by triangulation calculations performed upon reception of a signal transmitted from a golf ball, said first distance representative of a distance of a respective stroke in a direction parallel to a centerline of a fairway and said second distance representative of a distance of a respective in a direction perpendicular to the centerline of the fairway; and storing in a first memory data field, for said plural strokes, said first and second distances.

75. A computer-based product as in claim 74, further storing instructions which can be used to program a processor to perform the following step:

storing in a second memory data field a play quality factor derived from said first and second distances stored in said first memory data field.

76. A computer-based product as in claim 74, further storing instructions which can be used to program a processor to perform the following step:

storing in a second memory data field times between strokes information.

77. A computer-based product as in claim 74, further storing instructions which can be used to program a processor to perform the following step:

storing in a third memory data field times between strokes information.

78. A computer-based product as in any one of claims 74, 75, or 76, further storing instructions which can be used to program a processor to perform the following step:

storing in a further memory data field golf ball locations for plural strokes.

79. A computer-based product as in any one of claims 74, 75, or 76, further storing instructions which can be used to program a processor to perform the following step:

storing in a further memory data field ball flight data for plural strokes.

80. A golf ball position location device comprising:

an input section configured to receive golf ball position location information derived by remote performance of triangulation calculations performed on signals received by remote receivers for a signal transmitting golf ball transmitter;

a display coupled to the input section and configured to display at least one signal indicating the location of the golf ball in relation to a two-dimensional area including the location of the golf ball; and a computer-based product storing computer instructions which can be used to program a processor to perform the following steps:

determining a distance of ball travel in a direction parallel to a fairway and a distance of ball travel in a direction perpendicular to the fairway for at least one of selected strokes; and storing the determined distances in a memory.

81. A device as in claim 80, further comprising:

said computer-based product storing computer instructions which can be used to program a processor to perform the following steps:

determining times between at least two of said selected strokes; and storing the determined times in a memory.

82. A device as in claim 81, further comprising:

said computer-based product storing computer instructions which can be used to program a processor to perform the following steps:

adding selected of the times stored in said memory to produce a corresponding sum;

comparing the sum of the added times with a predetermined value; and outputting a signal indicative of when the sum exceeds said predetermined value.

83. A device as in claim 81, further comprising:

said computer-based product storing computer instructions which can be used to program a processor to perform the following steps:

adding selected of the times stored in said memory to produce a corresponding sum;

comparing the sum of the added times with a predetermined value; and outputting a signal indicative of when the sum exceeds said predetermined value.

84. A device as in claim 80, further comprising:

said computer-based product storing computer instructions which can be used to program a processor to perform the following steps:

determining for plural strokes a zone in which the golf ball comes to rest;

assigning to at least selected strokes a quality number corresponding to the respective zone in which the golf ball comes to rest; and storing the assigned quality number for at least one of said selected strokes in a memory.

85. A device as in claim 84, further comprising:

said computer-based product storing computer instructions which can be used to program a processor to perform the following steps:

determining a play quality factor based on selected of the stored quality numbers; and outputting a signal indicative of the determined play quality factor.

86. In a golf ball locator system in which an electromagnetic signal transmitter provided in a golf ball emits a signal when the golf ball is hit by a golfer, the improvement comprising:

at least two electromagnetic signal receivers configured to receive an electromagnetic signal transmitted by the golf ball; and a processor coupled to the receivers and configured to receive signals from the receivers, to determine a location of the golf ball using triangulation calculations, and to output at least one signal indicating the location of the golf ball in relation to a two-dimensional area including the location of the golf ball.

* * * * *